US011352032B2

(12) United States Patent
Braatz et al.

(10) Patent No.: US 11,352,032 B2
(45) Date of Patent: Jun. 7, 2022

(54) UNIVERSAL RETARDER SYSTEM FOR RAILWAY CARS

(71) Applicant: Precision Rail and MFG., Inc., Oak Creek, WI (US)

(72) Inventors: James D. Braatz, Greenfield, WI (US); Donald C. Noll, Menomonee Falls, WI (US); William D. Straub, Elm Grove, WI (US)

(73) Assignee: Precision Rail and MFG., Inc., Oak Creek, WI (US)

( * ) Notice: Subject to any disclaimer, the term of this patent is extended or adjusted under 35 U.S.C. 154(b) by 258 days.

(21) Appl. No.: 16/433,331

(22) Filed: Jun. 6, 2019

(65) Prior Publication Data

US 2019/0382038 A1 Dec. 19, 2019

Related U.S. Application Data

(60) Provisional application No. 62/684,289, filed on Jun. 13, 2018.

(51) Int. Cl.
*B61K 7/08* (2006.01)
*B61K 7/12* (2006.01)

(52) U.S. Cl.
CPC . *B61K 7/08* (2013.01); *B61K 7/12* (2013.01)

(58) Field of Classification Search
CPC ..... B61K 7/08; B61K 7/12
USPC ..... 188/62
See application file for complete search history.

(56) References Cited

U.S. PATENT DOCUMENTS

| | | | | | |
|---|---|---|---|---|---|
| 1,868,493 | A * | 7/1932 | Clausen | B61K 7/04 | 188/62 |
| 1,996,139 | A * | 4/1935 | Bone | B61K 7/08 | 188/62 |
| 2,044,762 | A * | 6/1936 | Bone | B61K 7/08 | 188/62 |
| 2,089,823 | A * | 8/1937 | Bone | B61K 7/08 | 188/62 |
| 2,679,809 | A * | 6/1954 | Beltman | B61K 7/08 | 246/182 A |
| 3,163,259 | A * | 12/1964 | Brown | B61K 7/08 | 188/62 |
| 3,209,865 | A | 10/1965 | Wynn | | |
| 3,403,752 | A | 10/1968 | Garrett, Jr. et al. | | |
| 3,819,017 | A | 6/1974 | Noble | | |
| 3,827,533 | A | 8/1974 | Noble | | |
| 4,030,574 | A * | 6/1977 | Evans | B61K 7/08 | 188/62 |
| 4,393,960 | A | 7/1983 | Mazur et al. | | |

(Continued)

*Primary Examiner* — Bradley T King
(74) *Attorney, Agent, or Firm* — Andrus Intellectual Property Law, LLP

(57) ABSTRACT

A universal retarder system for slowing a railcar on rails. The system includes a lever arm configured to be pivotable within a vertical plane, where the lever arm is configured to support a brake shoe. An engagement device is coupled to the lever arm and configured to pivot the brake shoe towards one of the rails. A disengagement device is coupled to the lever arm and configured to pivot the brake shoe away from the one of the rails. The lever arm, engagement device, and disengagement device are each positioned between the rails. Pivoting the brake shoe towards the one of the rails is configured to force the brake shoe into engagement with the railcar to slow the railcar.

20 Claims, 8 Drawing Sheets

(56) References Cited

U.S. PATENT DOCUMENTS

| | | | | |
|---|---|---|---|---|
| 4,867,279 | A * | 9/1989 | Link | B61K 7/08 188/62 |
| 5,029,675 | A * | 7/1991 | Zhukov | B61J 3/06 188/62 |
| 6,152,042 | A | 11/2000 | Barry et al. | |
| 6,829,998 | B1 | 12/2004 | Kickbush | |
| 7,306,077 | B2 | 12/2007 | Heyden et al. | |
| 7,392,887 | B2 | 7/2008 | Heyden et al. | |
| 8,413,770 | B1 | 4/2013 | Heyden et al. | |
| 8,899,385 | B2 | 12/2014 | Frailing et al. | |
| 9,862,368 | B2 | 1/2018 | Majeskie et al. | |
| 2008/0237511 | A1 | 10/2008 | Heyden et al. | |
| 2010/0252372 | A1 | 10/2010 | Heyden | |
| 2013/0068124 | A1 | 3/2013 | Kickbush | |

* cited by examiner

UNIVERSAL RETARDER SYSTEM FOR RAILWAY CARS

CROSS REFERENCE TO RELATED APPLICATION

The present application is based on and claims priority to U.S. Provisional Patent Application Ser. No. 62/684,289, filed Jun. 13, 2018, the disclosure of which is incorporated herein by reference.

FIELD

The present disclosure generally relates to retarder systems for railway cars, and more particularly to a universal system for railway cars incorporating springs, pneumatic and/or hydraulic cylinders for tangent, skate, and other retarders.

BACKGROUND

The Background and Summary are provided to introduce a foundation and selection of concepts that are further described below in the Detailed Description. The Background and Summary are not intended to identify key or essential features of the potentially claimed subject matter, nor are they intended to be used as an aid in limiting the scope of the potentially claimed subject matter.

The following U.S. Patents and Patent Applications are incorporated herein by reference:

U.S. Pat. No. 4,393,960 discloses a brake shoe structure which includes a series of alternating long brake shoes and short brake shoes mountable on adjacent brake beams in a railroad car retarder. The length of the long brake shoe is such that the long brake shoe symmetrically straddles two adjacent brake beams. The length of the short brake shoe is such that the shoe occupies the spacing on the brake beams between two long brake shoes. The long brake shoes are affixable to each of the brake beams at at least two points. The brake shoes contain a plurality of slanting slots in their braking surfaces for interrupting harmonics procuring screeching noises during retardation. The brake shoes may be formed of steel or heat treatable ductile iron.

U.S. Pat. No. 7,306,077 discloses a fail-safe skate retarder that applies a braking force proportional to the weight of a rail car entering the retarder. Each segment of the retarder includes a lever mechanism with a pair of levers rotatably joined under the running rail. Each lever holds a braking rail for engaging a wheel of the car. The retarder is normally in a lower, fail-safe position with the brake rails closer together than the width of the wheel. When the car enters the retarder, the wheel forces the brake rails apart into a braking position, and the middle of the lever mechanism rises to lift the running rail and car. A hydraulic power unit and cylinder is activated to raise the middle of the lever mechanism even further to a release position so that the brake rails are spread apart more than the width of the wheel.

U.S. Pat. No. 7,392,887 discloses a low-maintenance bladder actuator for a low-profile railroad retarder. The actuator has an internal guide mechanism and internal limit stops. The guide mechanism has a concentric, telescoping guide rod and guide sleeve that are removably bolted to upper and lower plates. An integral cast head forms the upper plate and a stop sleeve that absorbs the cyclical 20,000 pound loads of the actuator. This enables the guide rod to remain concentrically aligned. The guide mechanism has sufficient stroke length ($S_L$) and includes a long internal bushing with a low wear rate. The stop sleeve engages the lower plate to form the lower limit stop. The stop sleeve includes an inwardly extending flange that engages an outwardly extending flange of the guide sleeve to form an upper limit stop. The stop sleeve and guide sleeve form a cam lock connection for easy assembly.

U.S. Pat. No. 8,413,770 discloses systems and methods for retarding the speed of a railcar are provided. A supply of pressurized hydraulic fluid is provided to a piston cylinder to actuate the cylinder and thereby move a brake into a closed position in which the brake will apply a predetermined braking pressure to a wheel of the railcar. An accumulator accumulates fluid from the circuit when the wheel forces the brake out of the closed position and supplies accumulated fluid back to the circuit as the brake moves back into the closed position to thereby maintain a substantially constant braking pressure on the wheel as it moves through the retarder.

U.S. Pat. No. 8,899,385 discloses systems for retarding the speed of a railcar comprise: a brake; a hydraulic actuator moving the brake between a closed position in which the brake applies braking pressure on a wheel of the railcar and an open position in which the brake does not apply braking pressure on the wheel of the rail car; a hydraulic circuit comprising a first manifold and a second manifold; a pump configured to pump hydraulic fluid into at least one of the first manifold and the second manifold; and a logic element controlling pressure of the fluid in the first manifold such that when the wheel enters the brake and forces the brake towards the open position. The logic element reacts to maintain a selected pressure in the first manifold, thus causing a selected braking pressure to be applied by the brake on the wheel of the railcar.

U.S. Pat. No. 9,862,368 discloses a system for retarding the speed of a railcar comprises a brake; a hydraulic actuator moving the brake between a closed position in which the brake applies braking pressure on the wheel of a railcar, and an open position in which the brake does not apply braking pressure on the wheel of the railcar; a hydraulic circuit provided with a pump arrangement for supplying hydraulic fluid to the hydraulic actuator; and a control circuit coupled to the hydraulic circuit for controlling the flow of hydraulic fluid to move the brake between the closed and open positions.

U.S. Patent Application Publication No. 2008/0237511 discloses an electro-pneumatic retarder control (EPRC) valve for a pneumatic retarder that controls the speed of railroad cars in a marshaling yard. The EPRC valve has a housing that generally encloses and protects its various components. The housing has a lid that can be opened to gain access to a control panel mounted on an interior door. The control panel includes a display, keyboard and programmable logic controller or PLC module that can be adjusted to set the desired pressure levels of the retarder. The EPRC valve has a modular pressure control assembly that includes an intake and exhaust manifold, a retarder supply and return manifold and several interchangeable control lines formed by like-shaped control valves and components. A pilot air control assembly enables the PLC module to selectively open and close the control valves and lines to deliver or release pressurized air to the retarder.

U.S. Patent Application Publication No. 2010/0252372 discloses several embodiments of a system for connecting brake shoes to brake beams in a railroad car retarder all provide enhanced connecting joint tightness that reduces premature connecting joint loosening, reduces maintenance, and reduces failure of connecting bolts or equivalent connecting pins.

SUMMARY

One embodiment of the present disclosure generally relates to a universal retarder system for slowing a railcar on rails. The system includes a lever arm configured to be pivotable within a vertical plane, where the lever arm is configured to support a brake shoe. An engagement device is coupled to the lever arm and configured to pivot the brake shoe towards one of the rails. A disengagement device is coupled to the lever arm and configured to pivot the brake shoe away from the one of the rails. The lever arm, engagement device, and disengagement device are each positioned between the rails. Pivoting the brake shoe towards the one of the rails is configured to force the brake shoe into engagement with the railcar to slow the railcar.

Another embodiment generally relates to a universal retarder system for slowing a railcar on rails. The system includes a lever arm configured to be pivotable about a horizontal axis parallel to the rails, where the lever arm is configured to support a brake shoe, the lever arm has a proximal end force mount configured to receive a proximal force to pivot the lever arm, and the lever arm has a distal end force mount configured to receive a distal force to pivot the lever arm. A proximal support and a distal support are each configured span between adjacent ties supporting the rails. The proximal support is configured to support one of an engagement device and a disengagement device for applying the proximal force on the lever arm, and the distal support is configured to support an other of the engagement device and the disengagement device for applying the distal force on the lever arm. The lever arm, engagement device, and disengagement device are each positioned between the rails. The one of the proximal force and the distal force applied by the engagement device causes the lever arm to pivot to thereby force the brake shoe into engagement with the railcar to slow the railcar.

Another embodiment generally relates to a universal retarder system for slowing a railcar on rails. The system includes a lever arm configured to be pivotable within a vertical plane, where the lever arm is configured to support a brake shoe. An engagement device is coupled to the lever arm and configured to pivot the brake shoe towards one of the rails. A disengagement device is coupled to the lever arm and configured to pivot the brake shoe away from the one of the rails. The lever arm, engagement device, and disengagement device are each positioned between the rails. The lever arm is pivotable about an axis that is closer than both of the engagement device and the disengagement device to the one of the rails, and the lever arm has a length greater than half of a distance between the rails. Pivoting the brake shoe towards the one of the rails is configured to force the brake shoe into engagement with the railcar to slow the railcar.

BRIEF DESCRIPTION OF THE DRAWINGS

The drawings illustrate embodiments for carrying out the disclosure. The same numbers are used throughout the drawings to reference like features and like components. In the drawings.

DETAILED DISCLOSURE

Figure 1:
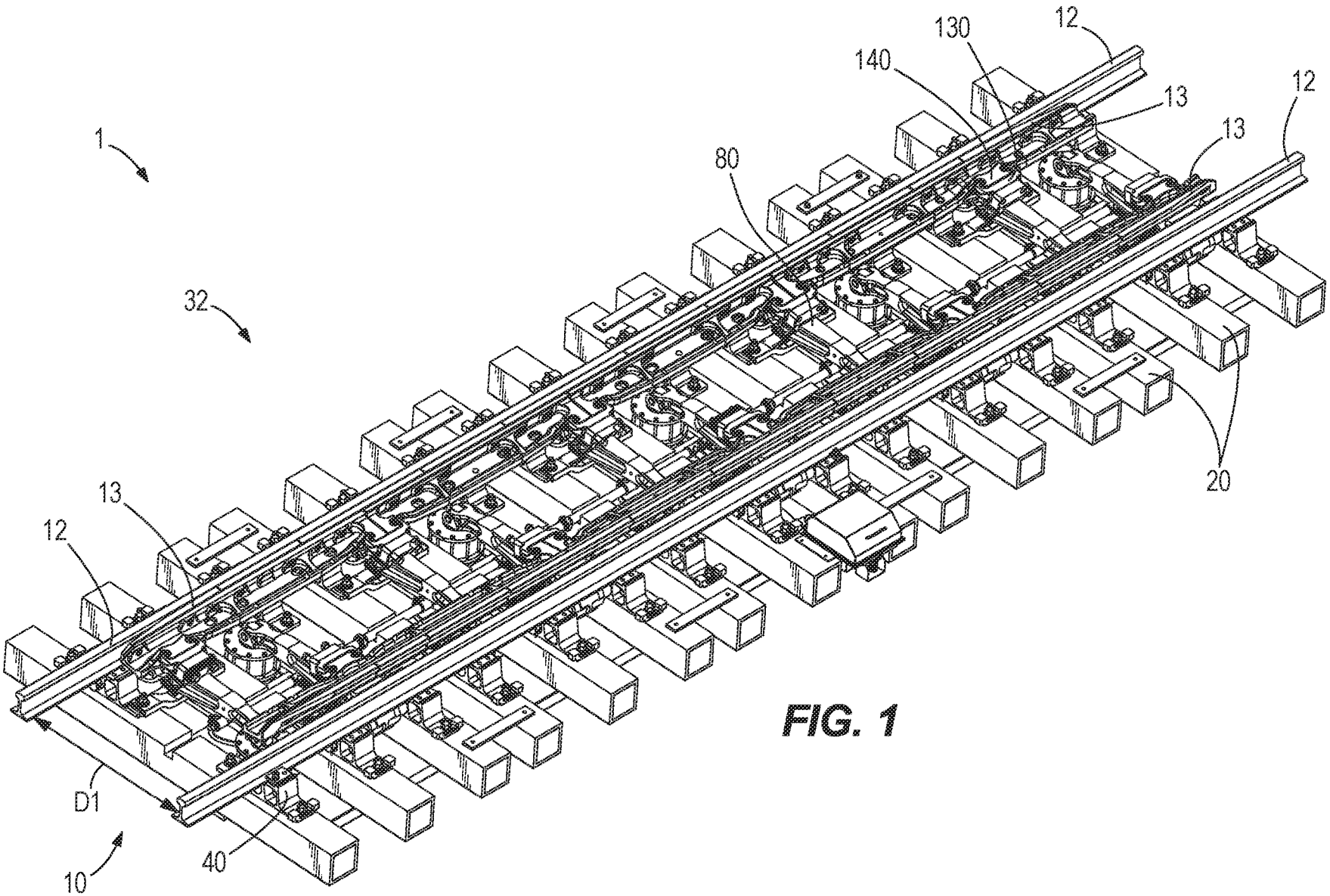
FIGS. 1-2 depict top and bottom views of an exemplary retarder system incorporated in railroad tracks according to the present disclosure.

This written description uses examples to disclose embodiments of the present application and also to enable any person skilled in the art to practice or make and use the same. The patentable scope of the invention is defined by the potential claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The present inventors have identified several issues with retarder systems presently known in the art for slowing or stopping a railcar on a railroad track, particularly within the context of a rail yard. First, it is often desirable to place tracks as close together as possible, minimizing the amount of space required to provide many separate lines within a yard. However, it is also desirable to provide sufficient clearance between tracks such that personnel and equipment can navigate between adjacent tracks. In this regard, the present inventors have identified that it would be beneficial for the equipment associated with retarder systems to be located within the rails of a given track, rather than including components that sit outside of the rails as is customary with retarder systems known in the art. This maximizes the effective (usable) space between tracks, while also reducing tripping hazards and the potential for damaging retarders and other equipment.

While other retarder systems have been developed that are mostly or entirely contained within the rails of a track, these systems are overly complex, difficult to service, overly expensive, and/or lack the performance and reliability desired. Exemplary embodiments of other systems placing components primarily between the rails of a track include those described in U.S. Pat. No. 6,829,998 and U.S. Patent Application Publication No. 2013/0068124. These systems each incorporate components that rotate about a vertical axis to apply or retract braking elements to slow or stop a railcar. While these systems are contained primarily within the rails of the track, each nonetheless suffers from the other disadvantages previously described, including complexity, cost, and maintenance time.

The present inventors have also identified further issues with systems presently known in the art, including the systems described in U.S. Pat. No. 6,829,998 and U.S. Patent Application Publication No. 2013/0068124. In particular, these systems provide a conduction path between the individual rails of a track system. Many rail yards incorporate devices and equipment that require the individual rails within a track to be electrically isolated. For example, certain systems for detecting the presence of a car on a track function by providing a low voltage on one individual rail, then detecting the presence of the voltage on the opposite rail. When a car is present, the car completes the circuit such that the low voltage is conducted between the individual rails, thereby allowing detection of the presence of the railcar on that segment of the track.

However, when retarder systems create a shunt between the individual rails, irrespective of the presence of a railcar thereon, these car detection systems are rendered inoperable. This places a yard manager in the difficult situation of either selecting only among retarder systems that allow existing railcar detection systems to function, or selecting a retarder system knowing that it will render the railcar detection system inoperable. Since the detection of railcars on a given segment of track is critical for managing the yard, this obstacle often precludes the availability of alternative retarder systems for upgrading or replacing as existing retarder systems fail or are replaced.

One way that retarder systems known in the art end up shunting the individual rails is through the use of steel ties or other steel reinforcement structures that are tied between the individual rails. Likewise, steel within other components of the retarder system that at some point contact both individual rails (whether directly or indirectly) also creates a conduction pathway between the individual rails, rendering the railcar detection systems inoperable as described above.

Figure 2:
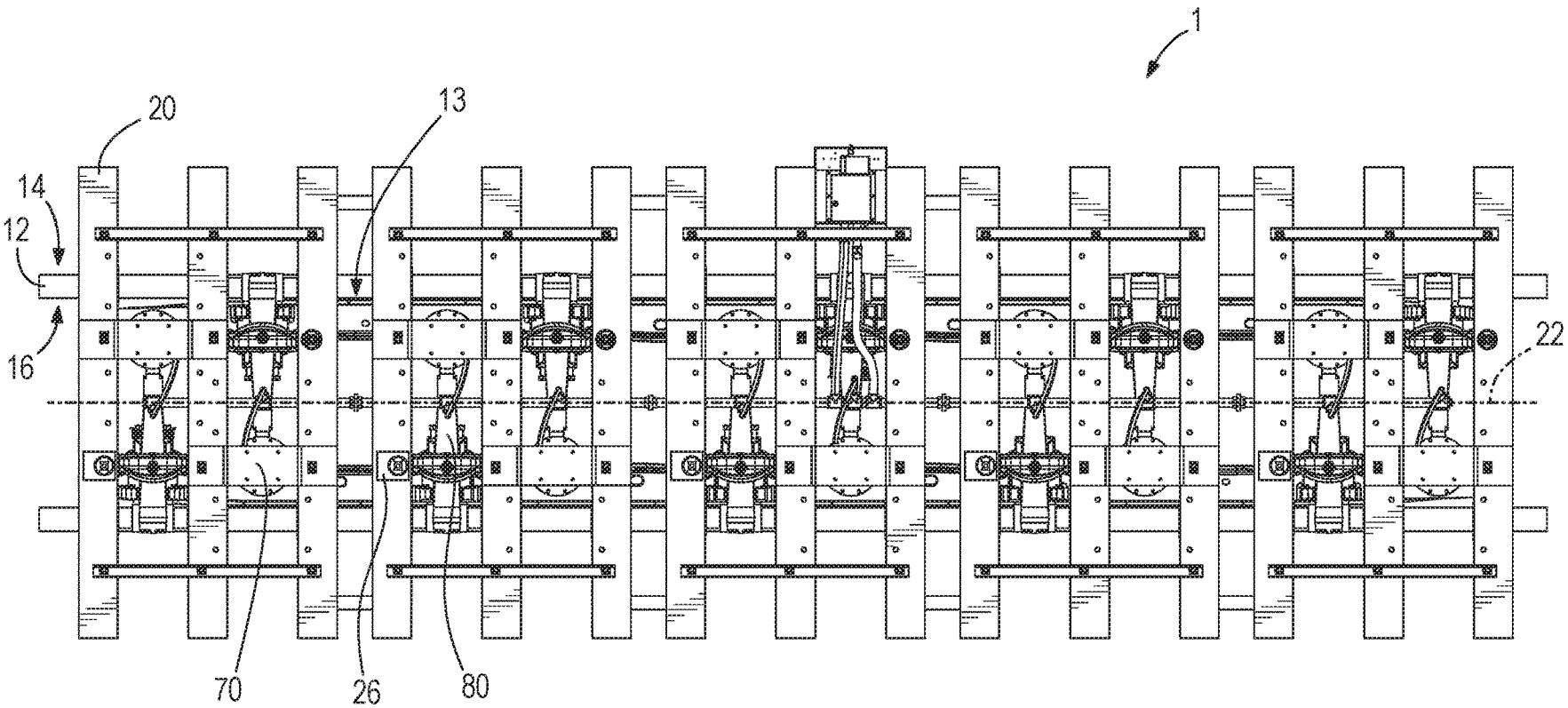

FIGS. 1-2 depict an exemplary embodiment of a universal retarder system 1 incorporated in a track 10 known in the art. The track 10 includes running rails 12 and brake shoes 13 and the track 10 is anchored by a series of ties 20. The particular embodiment shown is a tangent retarder system 32 configured to selectively slow a rail car on the tracks 10 in the customary manner. The running rails 12 are separated by a distance D1 and coupled to the ties 20 via chairs 40 in the manner known in the art.

As best shown in the bottom view of FIG. 2, the running rails 12 have a field side 14 and a gauge side 16, where the gauge sides 16 of the respective running rails 12 face inwardly towards each other. A center line 22 runs between the running rails 12. As will be discussed later, FIG. 2 further shows the integration of distal supports 70 and steel filler plates 26 for mounting components of the presently disclosed universal retarder system 1.

FIGS. 1-2 further depict the incorporation of lever arms 80, which are presently shown in an offset configuration such that adjacent lever arms 80 operate the brake shoes 13 corresponding to the opposing running rails 12. As will be discussed further below, a proximal end 82 of each lever arm 80 is coupled to the brake shoes 13 via brake shoe beams 140 in the manner known in the art.

The present inventors have identified that by providing an offset configuration of the lever arms 80, each lever arm 80 can be extended in length L (FIG. 3), providing further mechanical advantage for applying or releasing braking. Moreover, the lever arm 80 remains perpendicular to the brake shoes 13, in contrast to systems in the prior art that are positioned within the rails 10. This again provides maximum mechanical advantage and alignment, specifically by pivoting on a horizontal pivot axle 50 (see FIG. 3). This is also referred to as pivoting within a vertical plane that is perpendicular to the ground, and also perpendicular to the length of the rails 12. By harnessing this additional mechanical advantage, a greater force can be applied to the brake shoes 13, using smaller or less powerful mechanisms than those presently required. This not only saves on cost and complexity, but also in a reduced amount of space and supporting structure for mounting such force-generating devices.

Figure 3:
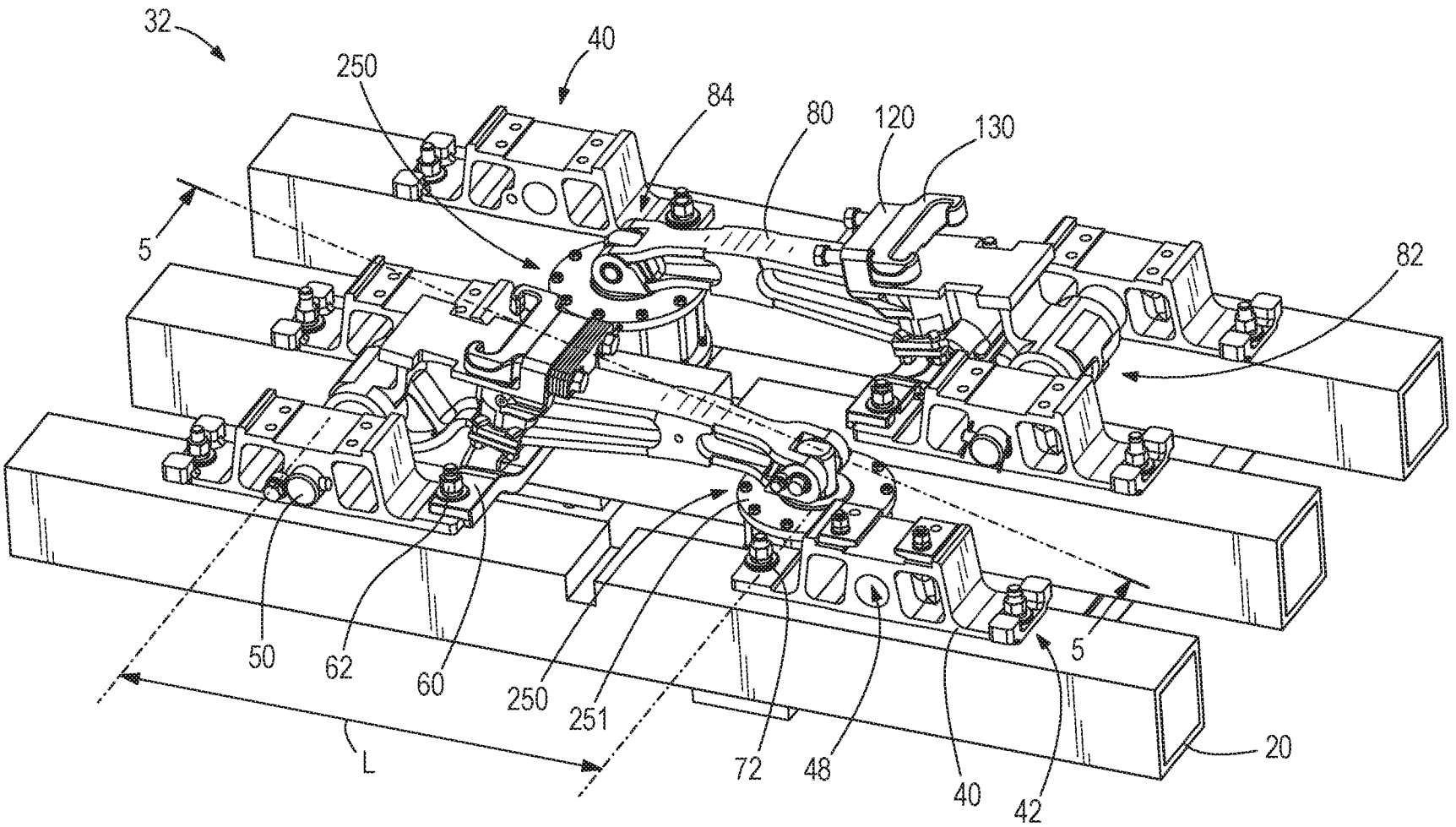
FIGS. 3-4 are isometric and exploded close up views of a portion of one retarder system according to the present disclosure.
Figure 4:
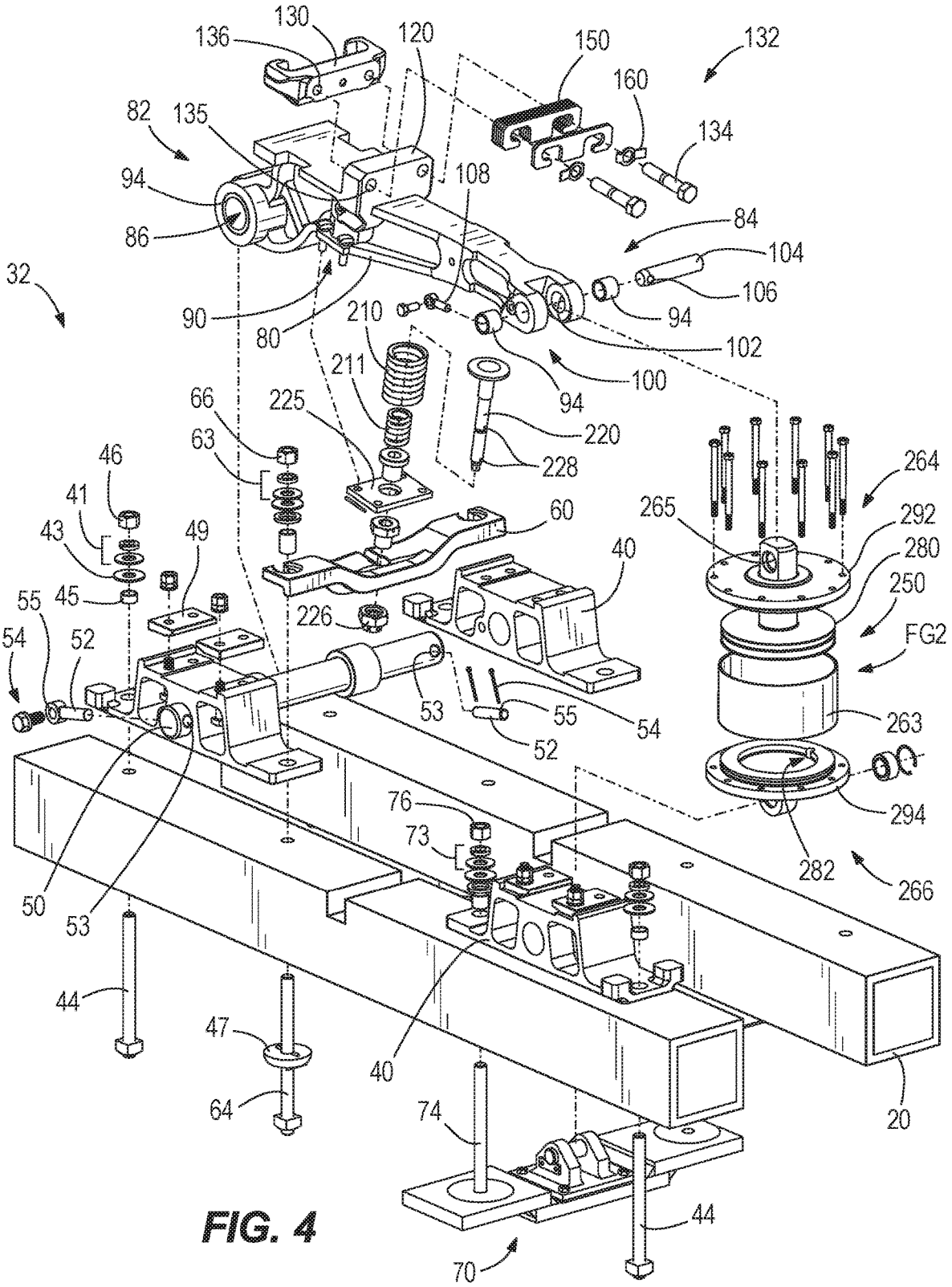
Figure 5:
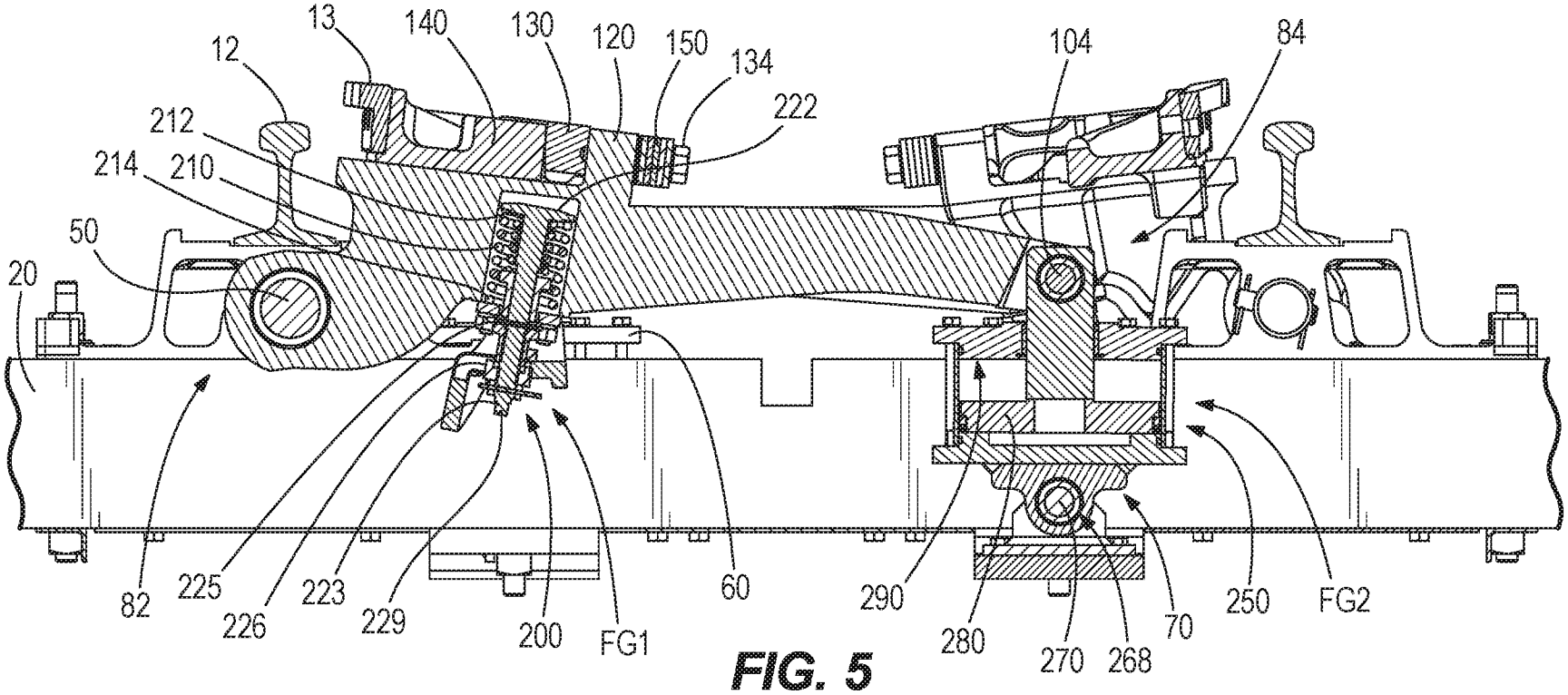
FIG. 5 depicts a sectional side view of a tangent retarder in a released state according to the present disclosure taken along the line 5-5 in FIG. 3.

FIGS. 3-5 depict one exemplary embodiment of a tangent retarder system 32 configuration of the universal retarder system 1 according to the present disclosure. In the embodiment shown, the system 1 is configured such that the brake shoes 13 are not normally engaged to cause braking for a railcar, but can be engaged with the application of force, such as through the cylinder system 250 presently shown. As previously described, the lever arms 80 are rotatably coupled to the ties 20 by chairs 40. The chairs 40 are coupled to the ties 20 via mounting hardware 42, which may include bolts 44, nuts 46, and washers 41 (FIG. 4). The chairs 40 include pivot axle receivers 48 that receive the pivot axle 50 for rotatably coupling the chair 40 and the lever arm 80.

As shown in FIG. 4, the mounting hardware 42 further incorporates a nonconductive washer 43 and a nonconductive bushing 45 (for example, made of fiber) to electrically isolate a proximal support 60 and a distal support 70 that are also mounted to the chairs 40 of adjacent ties 20. In certain embodiments, a nonconductive bushing 94 is provided between the lever arm 80 and the pivot axle 50, between the lever mounting pin 104 and the lever arm 80, and/or in other mounting and pivoting locations, to provide this same electrical isolation.

The proximal support 60 and distal support 70 are directly or indirectly mounted to the ties 20 via mounting hardware 62 and mounting hardware 72, respectively (FIG. 3). As shown in FIG. 4, the mounting hardware 62 may include bolts 64, nuts 66, and washers 63, just as the mounting hardware 72 may incorporate bolts 74, nuts 76, and washers 73. Other techniques for coupling the proximal support 60 and/or distal support 70 are also anticipated by the present disclosure.

The chairs 40 further include tie bolt washers 47 and rail clips 49, as well as steel filler plates 26 (FIG. 2) on the opposite side of the tie 20 to serve as anchors. As previously described, the proximal support 60 and distal support 70 are also coupled between adjacent chairs of adjacent ties 20. The proximal support 60 for the universal retarder system 1 provides a place for mounting a first force generator FG1 to act upon the lever arm 80, presently shown as the spring system 200 (FIG. 5). Likewise, the distal support 70 provides an anchoring position for a second force generator FG2, presently shown as a cylinder system 250 (FIG. 5).

In this manner, the lever arm 80 is pivotable about the pivot axle 50 relative to the chair 40 to selectively release and engage braking of the universal retarder system 1. As shown in FIG. 4, the pivot axle 50 defines a retention pin receiver 53 that receives a retention pin 52 perpendicularly therein. The retention pin 52 further defines a locking pin receiver 55, which receives a locking pin 54 to ensure that the retention pin 52 is retained within the pivot axle 50, which ensures that the pivot axle 50 is retained within the chair 40. It should be noted that while other embodiments for locking and retaining pivoting axles and mounts are discussed further below, this same system of retention pins and/or locking pins can be used for any of the pivot axles or rotating members described herein.

The pivot axle 50 is further received within a pivot axle opening 86 within a lever arm 80, particularly located near the proximal end 82. In certain embodiments, a bushing 94 is provided to electrically isolate the lever arm 80 from the pivot axle 50. A rotation face 83 at the proximal end 82 is configured to face the chair 40 on each side of the lever arm 80 (in some cases prevented from making contact by the bushing 94 as discussed). In this manner, mechanical advantage is most exploited because forces are applied towards the distal end 84 of the lever arm 80. The presently disclosed universal retarder system 1 permits the use of longer lever arms 80 than systems presently known in the art, particularly among systems retained between the running rails 12.

As best shown in FIG. 4, a proximal end force mount 90 is provided near the proximal end 82 of the lever arm 80 for coupling the lever arm 80 to a first force generator FG1, such as the spring system 200 presently shown. Likewise, a distal end force mount 100 near the distal end 84 allows for coupling of the lever arm 80 to the second force generator FG2, shown here as the cylinder system 250. As will become apparent, the first force generator FG1 and second force generator FG2 act as engagement and disengagement devices for the brake shoes 13 via the lever arms 80.

The distal end force mount 100 of the present embodiment includes a lever mounting pin receiver 102 configured to receive a lever mounting pin 104 that also engages with the cylinder system 250. Similarly to the pivot axle 50 previously discussed, the lever mounting pin 104 further defines a lever mounting pin lock receiver 106 that receives a lever mounting pin lock 108 to retain the lever mounting pin 104 within the distal end force mount 100.

Referring to FIG. 5, each lever arm 80 includes a brake beam mount 120 configured for coupling a thrust block 130. A thrust block 130 is then coupled to the brake shoe beams 140, which engage with the brake shoes 13 as previously discussed. The thrust block 130 is coupled to the brake beam mount 120 using adjustment fasteners 132, which may include bolts 134 that extend through openings 135 defined within the brake beam mount 120 and are received within receivers 136 defined within the thrust block 130, which in certain embodiments are threaded.

As previously discussed, FIGS. 3-5 depict an exemplary tangential retarder system 32 configuration of the universal retarder system 1. The lever arm 80 is normally positioned in a release position as shown in FIG. 5, which is principally caused by the spring system 200 in which a spring 210, or in certain cases also a secondary spring 211, return the lever arm 80 to the released position under tension. The spring 210 has a first end 212 and a second end (not separately numbered). In certain embodiments, the secondary spring 211 is provided such that each provides tension for a different portion of the overall stroke.

In certain embodiments (shown in FIGS. 4-5), the tension of the spring 210 is adjustable via an adjustable tension rod 220. The adjustable tension rod 220 has a first end coupler 222 and a second end coupler 223 having threads. A mounting plate 225 provides that, through adjustment of the nuts 226, tension can be added or relieved from the spring 210 (and/or secondary spring 211 when present) by drawing on the adjustable tension rod 220. Openings 228 are defined within the adjustable tension rod 220 and configured to receive a locking pin 229 (FIG. 5) therein. This allows the adjustable tension rod 220 to be locked in a certain position without the nuts 226 moving over time. In this manner, the amount of tension provided by the spring system 200 may be adjusted until the spring system 200 sufficiently returns the lever arm 80 to the released position at rest. It should be recognized that other systems for returning the lever arm 80 to the released position are also anticipated by the present disclosure, including the use of pneumatic or hydraulic cylinders, or gas springs, for example.

The universal retarder system 1 permits multiple different biasing systems to be incorporated and mounted to the proximal support 60 for applying a force near the proximal end 82 of the lever arm 80, and likewise to the distal support 70 for applying a force near the distal end 84 of the lever arm 80 (see FIG. 5). It should also be recognized, and is discussed further below, that instead of the force applied near the proximal end 82 of the lever arm 80 being a downward force to move towards in the released direction (i.e., using a tension type spring 201), a force may be applied in the upward or engaging direction to instead cause a braking effect on the brake shoes 13 (i.e. as a skate retarder system 34 using a compression type spring 202). Moreover, a single device, such as a dual acting hydraulic cylinder, may be used to move the lever arm 80 in either direction selectively.

In the tangent retarder system 32 shown in FIG. 5, the second force generator FG2 is a cylinder system 250, which is presently shown as a pneumatic cylinder 251. The cylinder system 250 is operated with lines, pumps, and controlling devices in the customary manner. Actuation of the cylinder system 250 causes pressurization and movement of the piston 280 to move upwardly, which rotates the lever arm 80 about the pivot axle 50 to engage braking by the brake shoes 13.

As shown in FIG. 4, the cylinder system 250 has a piston 280 that is movable by exchange of air though a port 282. In the embodiment shown, the piston 280 is retained within a housing 263 sandwiched between a top cover 292 and a base cover 294. In the present embodiment, the port 282 is defined within the base cover 294, though other locations are anticipated in addition or in the alternative.

Referring to FIGS. 4-5, the cylinder system 250 has a first end 264 configured to rotatably engage via the lever arm 80 with the lever mounting pin 104 previously discussed. In particular, the cylinder system 250 includes a lever mounting pin receiver 265 that receives the lever mounting pin 104. The cylinder system 250 further has a second end 266 that rotatably couples to the distal support 70 via a base mounting pin 270, which is received within a base mounting pin receiver 268 defined within the distal support 70. The base mounting pin 270 further defines a mounting pin lock receiver that receives a mounting pin lock to retain the base mounting pin 270 in the manner previously described with respect to the lever mounting pin 104 and/or pivot axle 50. The cylinder system 250 further includes stroke limiters 290, which in certain embodiments are simply the top cover 292 and/or the base cover 294.

Figure 6:
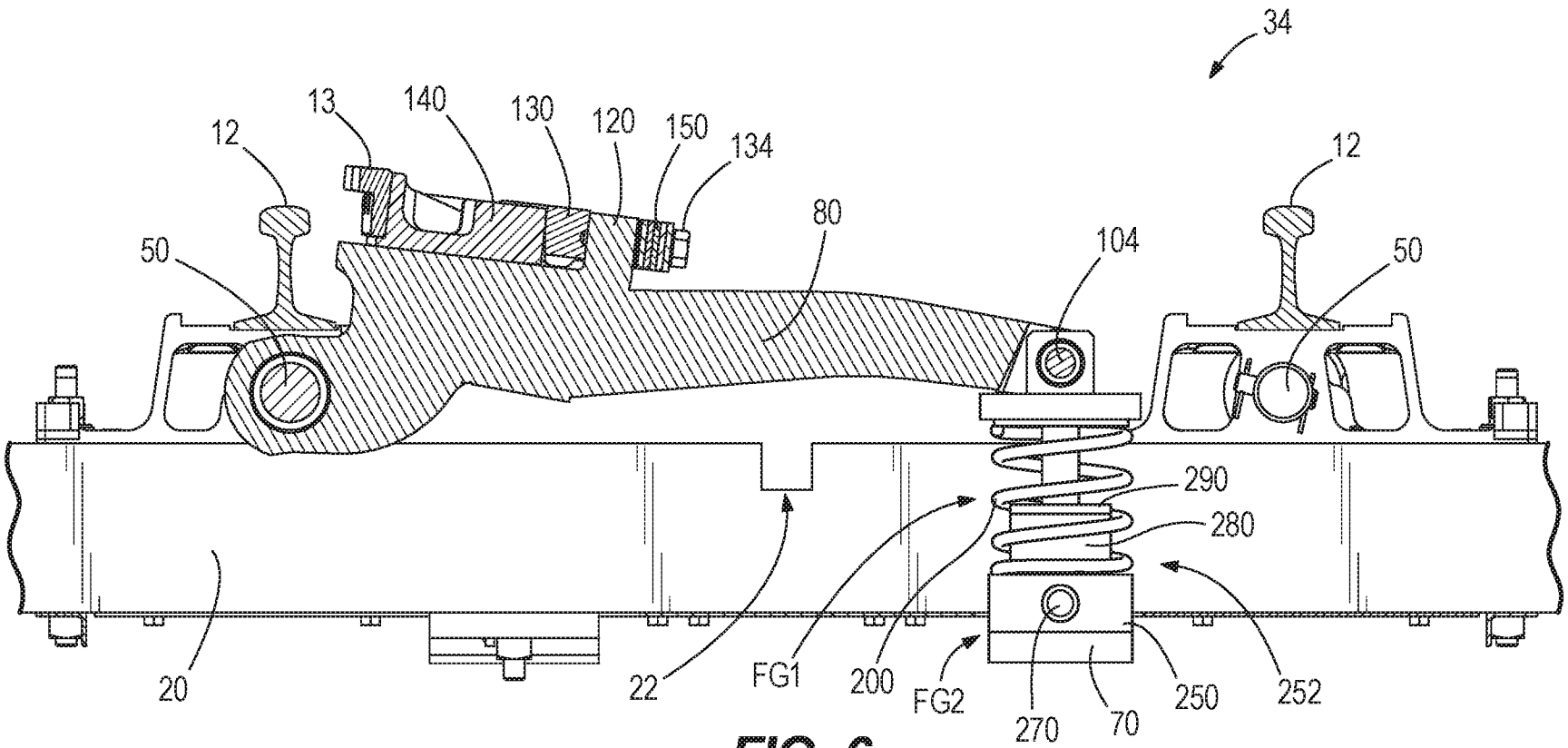
FIG. 6 depicts a sectional side view similar to that of FIG. 5, but of a skate retarder in a released state according to the present disclosure.
Figure 7:
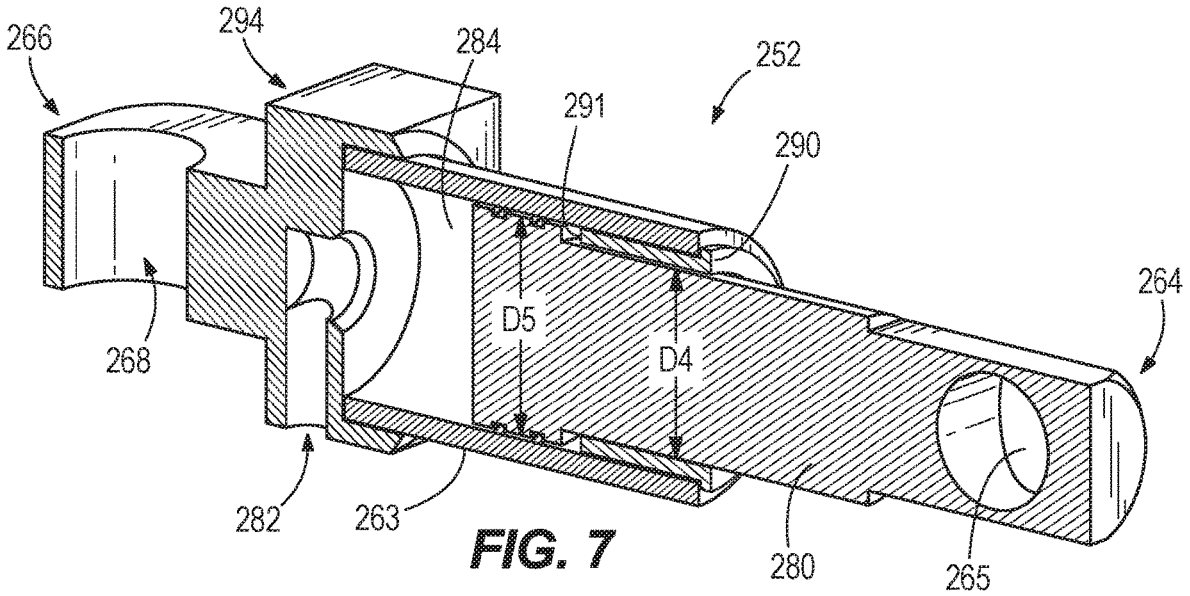
FIG. 7 depicts a sectional isometric view of one embodiment of a pneumatic cylinder that can be incorporated into the presently disclosed universal retarder system.

The presently disclosed universal retarder system 1 also allows the incorporation of a hydraulic cylinder 252 in place of the pneumatic cylinder 251 for the cylinder system 250 previously discussed, as shown in FIGS. 6-7. The hydraulic cylinder system 252 shares many of the components of the pneumatic cylinder system 251 of FIGS. 3-5, either of which may comprise off the shelf devices. In the embodiment shown, the hydraulic cylinder system 252 includes a housing 263 that like the housing 263 of the pneumatic system 251 previously discussed may be metallic or a composite material (i.e., to prevent issues with shorting across the running rails 12 or elsewhere). Further, the hydraulic cylinder system 252 shown in FIGS. 6-7 incorporate a stop tube as the stroke limiter 290, which includes a stop face 291 for limiting the stroke of the piston 280 upon contact. The stroke limiter 290 is selected to have the appropriate length and may be adhered to or threaded within the housing 263, for example. The hydraulic cylinder 252 is then pivotally coupled to the distal support 70 by the base mounting pin 270 as previously described. In certain embodiments, such as that shown in FIG. 6, the base mounting pin 270 is a trunnion style pivot that is incorporated within the base cover 294.

As shown in FIG. 6, the first force generator FG1 and the second force generator FG2, shown here as the spring system 200 and the hydraulic cylinder system 252, respectively rotate the lever arm 80 in the clockwise and counterclockwise direction about the pivot axle 50, causing the brake shoes 13 to engage or release through control of the cylinder system 250. In certain embodiments, the hydraulic cylinder 252 may also be dual-acting in a conventional manner, permitting the piston 280 to be extended or retracted to rotate the lever arm 80 in either direction.

In this embodiment, the proximal support 60 is no longer used, but a distal support 70 is used in the manner previously discussed. The skate retarder system 34 is configured as a fail-safe device, whereby the brake shoes 13 are normally engaged, for example by a passive spring system 200. Skate retarder devices 34 are frequently used in locations in which it is desirable for the railcars to be completely stopped, such as nearing the end of a line. In this manner, the function of the retarder is somewhat opposite of that previously discussed with the tangent retarder system 32, whereby engagement of a second force generator, such as the cylinder system 250, then causes disengagement of the lever arm 80 such that the brake shoes 13 are released.

Both the first force generator FG1 and second force generator FG2, namely the spring system 200 and cylinder system 250, are incorporated at the distal end 84 of the lever arm 80. In the embodiment shown, the spring 210 of the spring system 200 is positioned around the outer circumference of the cylinder system 250, which in the present example is a hydraulic cylinder 252. When hydraulic fluid is provided to the hydraulic cylinder 252 in the manner known in the art, entering the port 282 (FIG. 7) therein, the piston 280 is forced in the downward direction. In the embodiment shown, the hydraulic cylinder 252 is single-acting, retracting the piston 280 to compress the spring 210. This pulls down on the distal end 84 of the lever arm 80 to disengage the brake shoes 13 in the manner previously described. In contrast, when no hydraulic fluid is provided to the hydraulic cylinder system 252, the spring force provided by the spring 210 in the spring system 200 forces the lever arm 80 to rotate such that the brake shoes 13 reengage with the wheels of the railcar, causing it to slow and stop in the manner known.

It should be recognized that the universal retarder system 1 presently disclosed alternatively permits the spring system 200 to be located closer to the proximal end 82 of the lever arm 80 as previously shown, specifically through the integration of a proximal support 60. However, the present inventors have identified that mechanical advantages can be gained by moving the spring system 200 further toward the distal end 84 of the lever arm 80. Likewise, the universal retarder system 1 presently disclosed permits alternative systems to be incorporated for opposing the spring system 200, including use of a pneumatic cylinder system 251 in place of the hydraulic cylinder system 252 shown in FIGS. 3-5.

In this manner, the universal retarder system 1 presently disclosed permits the same lever arm 80 and corresponding support and rotational elements to be used for a tangent retarder system 32, a skate retarder system 34, or other retarder systems presently known in art. Moreover, it permits the inclusion of spring systems 200, whether in tension as shown in FIGS. 3-5, or compression as shown in FIG. 6, to bias or return the lever arm 80 in a desired position when no force is applied to the second force generator FG2. It should further be recognized that other forms of first force generator FG1 may also be incorporated, such as gas-powered springs. Moreover, the presently disclosed universal retarder system 1 permits the incorporation of multiple different types of secondary force generators FG2, including pneumatic cylinder systems 251, hydraulic cylinder systems 252, hybrid systems, systems that expand, retract, or both based on command by the fluid pump, and/or the like.

It is further known in the art that use of retarder devices causes wear on components over time. In order to accommodate for wear of the brake shoes 13, devices presently known in the art incorporate brake shoe shims 150 (presently disclosed embodiments of which are included in FIGS. 3-6 and 8A-9). However, the present inventors have identified that problems exist with brake shoe shims 150 known in the art and associated adjustment fasteners 132 for systems presently known in the art. First, the brake shoe shims 150 tend to move over time, in part due to the loosening of the adjustment fastener 132. In order to simplify the installation and adjustment of brake shoe shims 150 to accommodate for wear of the brake shoe 13, these brake shoe shims 150 are often retained in place by gravity, and then through tightening of the adjustment fasteners 132. However, loosening of the adjustment fasteners 132, and/or tension within the brake shoe 13, brake shoe beam 140, thrust block 130, and/or brake beam mount 120 can cause the brake shoe shims 150 to rise upwardly out of position, no longer providing the shimming effect necessary for a stable and structurally sound system.

Figure 8A:
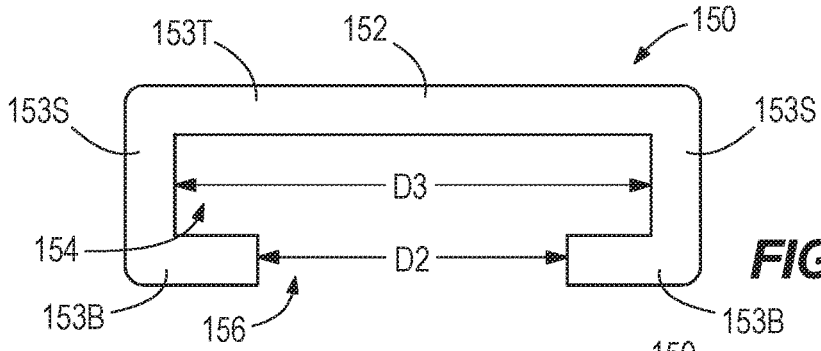
FIGS. 8A-9 depict exemplary brake shoe shims for incorporating into the presently disclosed universal retarder system.
Figure 8B:
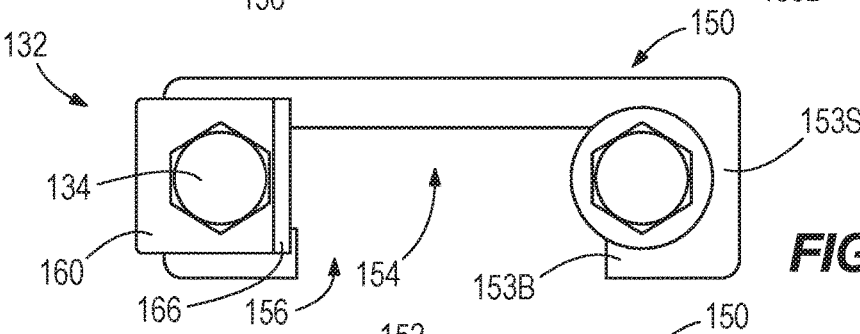
Figure 9:
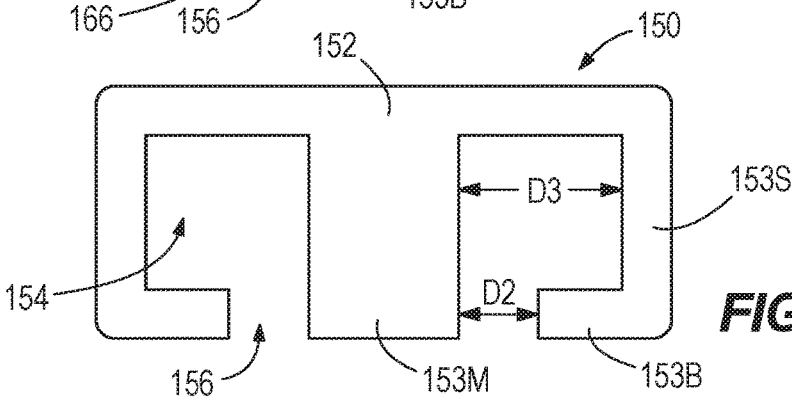

Accordingly, the present inventors have developed the presently disclosed brake shoe shims 150, which are best shown in the embodiment of FIGS. 8A-8B, and the embodiment of FIG. 9. As shown, the brake shoe shims 150 have a body 152 having a top 153T, sides 153S, bottom portions 153B, and in some embodiments a middle portion 153M, that together define one or more elongated openings 154 therein. A lower slot 156 provides that the brake shoe shims 150 can be installed or removed by removing only a single adjustment fastener 132, saving time and effort for installation and maintenance. In particular, the lower slot 156 within the body 152 has an inner diameter D2 that is smaller than the outer diameter D3, allowing some amount of lateral motion for the brake shoe shims 150 when one of the adjustment fasteners 132 is removed. However, as presently shown in FIG. 8B, once the adjustment fasteners 132 (such as bolts 134) are both installed, the brake shoe shim 150 is prevented from moving in any direction, including upwardly. Another embodiment of a brake shoe shim 150 according to the present disclosure is also shown in FIG. 9, which further limits the movement of an adjustment fastener 132 therein by incorporation of a middle portion 153M.

Figure 10:
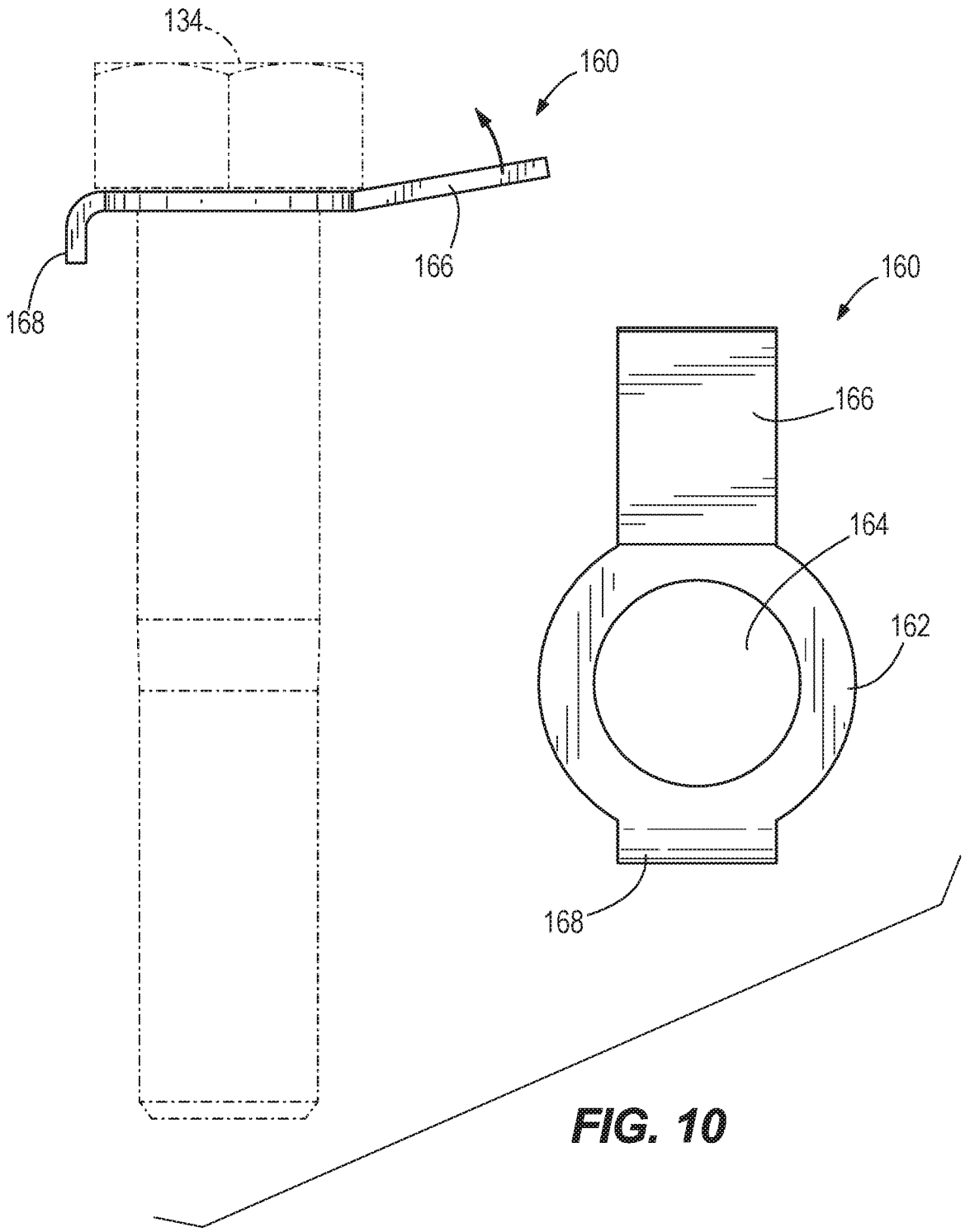
FIG. 10 depicts an exemplary tab washer for incorporating into the presently disclosed universal retarder system.

Similarly, the present inventors have identified that the incorporation of the presently disclosed tab washer 160, such as that shown in FIG. 10, advantageously prevents the adjustment fastener 132 (such as the bolt 134) from loosening relative to the brake shoe shims 150 over time. In particular, the tab washer 160 has a body 162 that defines a fastener opening 164 for receiving the bolt 134. The tab washer 160 further has a head end 166 and an anchor end 168, each of which are bendable in the manner shown transitioning in FIG. 9 from a flat configuration towards a bent configuration. In the embodiment shown, a bolt 134 having a hex head is incorporated such that bending the head end 166 of the tab washer 160 upwardly engages with one of the flat surfaces of the bolt 134. Likewise, the anchor end 168 can also be bent, such as to engage with an edge of the brake shoe shim 150 as shown in FIG. 8B. By bending the head end 166 to engage with the bolt 134, and also bending the anchor end 168 to engage with an immobile surface such as the brake shoe shim 150, the tab washer 160 prevents any rotation of the adjustment fastener 132 relative to the brake shoe shim 150 until the head end 166 and/or anchor end 168 become disengaged again.

It should be recognized that while the brake shoe shims 150 and tab washer 160 were describe above principally in the context of tangent retarder systems 32 and skate retarder systems 34, the integration of these devices (together or individually) is applicable across all types of retarders. Moreover, the brake show shims 150 and tab washers 160 may be incorporated into prior art designs and retarder systems already deployed in the field to provide benefits according in the present disclosure.

Collectively, the universal retarder system 1 provides all of the necessary functions for slowing or stopping the railcar while positioning all relevant equipment between the running rails 12. Likewise, the common lever arm 80 of each type of system allows for a reduced inventory of parts between supporting tangent retarder systems 32, skate retarder systems 34, and other forms of retarders incorporating the presently disclosed systems. The present inventors have identified that this is advantageous in initial manufacturing of these devices, but also in maintaining the necessary supply of replacement parts in the field, as well as reducing the time and effort for service and reducing the risk of error in the process.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A universal retarder system for slowing a railcar on rails, the system comprising:

a lever arm configured to be pivotable within a vertical plane, wherein the lever arm is configured to support a brake shoe;

an engagement device coupled to the lever arm and configured to pivot the brake shoe towards one of the rails; and a disengagement device coupled to the lever arm and configured to pivot the brake shoe away from the one of the rails;

wherein the lever arm, engagement device, and disengagement device are each positioned between the rails, and wherein at least one of the engagement device and the disengagement device is closer to a second of the rails than to the one of the rails; and wherein pivoting the brake shoe towards the one of the rails is configured to force the brake shoe into engagement with the railcar to slow the railcar.

2. The system according to claim 1, wherein the lever arm is configured to be pivotable about an axis that is horizontal and extends parallel to the rails.

3. The system according to claim 1, wherein the lever arm, the engagement device, and the disengagement device together form a first lever assembly pivotably towards a first of the rails, further comprising a second lever assembly comprising:

a second lever arm configured to be pivotable within a vertical plane and to support a second brake shoe;

a second engagement device coupled to the second lever arm and configured to pivot the second brake shoe towards a second of the rails; and a second disengagement device coupled to the second lever arm and configured to pivot the second brake shoe away from the second of the rails;

wherein at least one of the second engagement device and the second disengagement device is closer to the one of the rails than to the second of the rails.

4. The system according to claim 3, wherein the lever arm has a length greater than half of a distance between the rails.

5. The system according to claim 1, wherein the lever arm has a proximal end and an opposite distal end, wherein the proximal end is closer than the distal end to the one of the rails, wherein the lever is pivotable about an axis that is closer to the proximal end than to the distal end, and wherein the axis is closer than both engagement device and the disengagement device to the proximal end.

6. The system according to claim 1, wherein the lever arm has a proximal end and an opposite distal end, wherein the proximal end is closer than the distal end to the one of the rails, and wherein the engagement device is closer to the distal end than to the proximal end.

7. The system according to claim 1, wherein the engagement device is a hydraulic cylinder and the disengagement device is a spring.

8. The system according to claim 1, wherein the engagement device is a spring, further comprising an adjustable tension system for limiting decompression of the spring.

9. The system according to claim 1, wherein the rails are mounted on rail ties that extend perpendicularly to the rails, further comprising a proximal support and a distal support each configured span between adjacent ties of the rail ties, wherein the engagement device and the disengagement device each have a first end configured to be coupled to the lever arm, and wherein the engagement device and disengagement device each also have a second end opposite the first end that is configured to be coupled one of the proximal support and the distal support.

10. The system according to claim 9, wherein at least one of the engagement device and the disengagement device is coupled at the second end via trunnion.

11. The system according to claim 1, wherein the engagement device further comprises a stroke limiter that limits how far the engagement device pivots the lever arm.

12. The system according to claim 1, wherein the lever arm comprises a brake beam mount configured to receive a thrust block for supporting the brake shoe, wherein the thrust block is configured to be coupled to the brake beam mount via headed fasteners, further comprising tab washers for preventing rotation of the headed fasteners, wherein each of the tab washers has a body having a head end and an anchor end and defining a fastener opening therebetween, wherein the fastener opening is configured to receive the headed fastener therein, wherein the head end is configured to be angled to engage with a head of the headed fastener to prevent rotation of the tab washer relative to the headed fastener, and wherein the anchor end is configured to be angled to engage with at least one of the brake beam mount and one of the shims to prevent rotation between the tab washer relative to the brake beam mount.

13. The system according to claim 12, wherein the head end and the anchor end are each configured to be angled 90 degrees relative to a portion of the body defining the fastener opening.

14. The system according to claim 13, wherein at least one of the head end and the anchor end is bendable after the headed fasteners are coupled to the brake beam mount.

15. The system according to claim 1, wherein the rails remain electrically isolated from each other when the railcar is absent from the rails.

16. A universal retarder system for slowing a railcar on rails, the system comprising:

a lever arm configured to be pivotable within a vertical plane, wherein the lever arm is configured to support a brake shoe;

an engagement device coupled to the lever arm and configured to pivot the brake shoe towards one of the rails; and a disengagement device coupled to the lever arm and configured to pivot the brake shoe away from the one of the rails;

wherein the lever arm, engagement device, and disengagement device are each positioned between the rails;

wherein pivoting the brake shoe towards the one of the rails is configured to force the brake shoe into engagement with the railcar to slow the railcar; and wherein the lever arm is configured to be pivotably anchored to a chair, further comprising nonconductive hardware for pivotably coupling the lever arm to the chair such that electricity is prevented from flowing from the lever arm to the chair.

17. A universal retarder system for slowing a railcar on rails, the system comprising:

a lever arm configured to be pivotable within a vertical plane, wherein the lever arm is configured to support a brake shoe;

an engagement device coupled to the lever arm and configured to pivot the brake shoe towards one of the rails; and a disengagement device coupled to the lever arm and configured to pivot the brake shoe away from the one of the rails;

wherein the lever arm, engagement device, and disengagement device are each positioned between the rails;

wherein pivoting the brake shoe towards the one of the rails is configured to force the brake shoe into engagement with the railcar to slow the railcar; and wherein the lever arm comprises a brake beam mount configured to receive a thrust block for supporting the brake shoe, wherein the thrust block is configured to be coupled to the brake beam mount via headed fasteners, further comprising shims each coupleable to the lever arm both between the headed fasteners and the brake beam mount, and between the brake beam mount and the thrust block to thereby adjust a distance between the thrust block and the brake beam mount.

18. The system according to claim 17, wherein the shims each have a body that defines an elongated opening having an outer distance, wherein the body defines a lower slot that opens into the elongated opening, and wherein the lower slot has an inner distance that is less than the outer distance, wherein the shims are removable from the lever arm while one of the headed fasteners remains coupled to the brake beam mount only when another of the headed fasteners is removed.

19. The system according to claim 18, wherein the shims are substantially C-shaped.

20. A universal retarder system for slowing a railcar on rails, the system comprising:

a lever arm configured to be pivotable about a horizontal axis parallel to the rails, wherein the lever arm is configured to support a brake shoe, wherein the lever arm has a proximal end force mount configured to receive a proximal force to pivot the lever arm, and wherein the lever arm has a distal end force mount configured to receive a distal force to pivot the lever arm; and a proximal support and a distal support each to configured span between adjacent ties supporting the rails;

wherein the proximal support is configured to support one of an engagement device and a disengagement device for applying the proximal force on the lever arm, and wherein the distal support is configured to support an other of the engagement device and the disengagement device for applying the distal force on the lever arm;

wherein the lever arm, engagement device, and disengagement device are each positioned between the rails; and wherein the one of the proximal force and the distal force applied by the engagement device causes the lever arm to pivot to thereby force the brake shoe into engagement with the railcar to slow the railcar.

* * * * *